US009730561B2

(12) United States Patent
Heymann et al.

(10) Patent No.: US 9,730,561 B2
(45) Date of Patent: Aug. 15, 2017

(54) MULTIPURPOSE ROLLED TISSUE DISPENSER STAND

(71) Applicants: Daniel H Heymann, Saint Louis, MO (US); Cynthia A Heymann, Saint Louis, MO (US)

(72) Inventors: Daniel H Heymann, Saint Louis, MO (US); Cynthia A Heymann, Saint Louis, MO (US)

(73) Assignee: DANDY INNOVATION LLC, Saint Louis, MO (US)

( * ) Notice: Subject to any disclaimer, the term of this patent is extended or adjusted under 35 U.S.C. 154(b) by 115 days.

(21) Appl. No.: 14/625,823

(22) Filed: Feb. 19, 2015

(65) Prior Publication Data

US 2016/0242605 A1 Aug. 25, 2016

(51) Int. Cl.

| | |
|---|---|
| ***B26F 3/02*** | (2006.01) |
| ***A47K 10/38*** | (2006.01) |
| ***A47K 10/22*** | (2006.01) |
| *A47K 10/32* | (2006.01) |
| *B65H 16/04* | (2006.01) |
| *B65H 49/32* | (2006.01) |

(52) U.S. Cl.

CPC ..... *A47K 10/3836* (2013.01); *A47K 10/22* (2013.01); *A47K 2010/3233* (2013.01); *A47K 2010/3881* (2013.01); *B65H 16/04* (2013.01); *B65H 49/322* (2013.01); *Y10T 225/238* (2015.04)

(58) Field of Classification Search

CPC ..... A47K 10/405; A47K 10/3836; A47K 2010/3233; A47K 2010/389; A47K 10/3818; A47K 10/3827; A47K 10/22; A47K 2010/3881; B65H 16/04; B65H 49/18; B65H 49/32; B65H 49/322; Y10T 225/238

USPC ..... D6/518, 519; 225/45, 39, 72; 221/31, 221/32, 45, 46, 62, 63

See application file for complete search history.

(56) References Cited

U.S. PATENT DOCUMENTS

| | | | | |
|---|---|---|---|---|
| 3,227,386 A * | 1/1966 | Pitcher | A47K 10/3836 | 242/129.5 |
| 3,693,853 A * | 9/1972 | Siegal | B65H 35/002 | 225/58 |
| 4,655,409 A * | 4/1987 | Zima | B41J 15/04 | 242/538.1 |
| 4,659,028 A * | 4/1987 | Wren | A47K 10/3827 | 206/408 |

(Continued)

*Primary Examiner* — Kenneth E. Peterson
*Assistant Examiner* — Samuel A Davies
(74) *Attorney, Agent, or Firm* — Usha S. Koshy

(57) ABSTRACT

A multipurpose rolled tissue dispensing stand having a pair of tubular legs attached to a pair of tubular vertical rods further attached at their top ends to a horizontal rod holding a tissue dispensing unit comprised of a base plate holding a tissue dispensing orifice with a serrated edge at the front end and a handle with a lock at the back end. A tubular tissue holding rod is attached to the vertical rods and holds the rolled tissue on the stand. The handle on the base plate of the tissue dispensing unit can be unlocked and actuated to swing the base plate up when inserting the tissue roll into the tissue holding rod and actuated down to place the base plate locked over the tissue. A standard tissue dispensing box with an open bottom can be placed over the rolled tissue dispensing stand.

8 Claims, 4 Drawing Sheets

(56) References Cited

U.S. PATENT DOCUMENTS

| | | | | |
|---|---|---|---|---|
| 7,124,674 | B2 * | 10/2006 | Maxey | A47F 13/045 242/129.8 |
| D540,591 | S * | 4/2007 | Snell | D6/523 |
| 2007/0119858 | A1 * | 5/2007 | Ayoub | A47K 10/421 221/2 |
| 2010/0206896 | A1 * | 8/2010 | Ray | A47K 10/3818 221/45 |

* cited by examiner

MULTIPURPOSE ROLLED TISSUE DISPENSER STAND

FIELD OF THE INVENTION

The present invention generally relates to tissue dispensers. More particularly, the invention relates to a multipurpose rolled tissue dispenser stand to hold and dispense rolled facial tissues, with application to other rolled tissues such as toilet paper tissue and hand wipe tissues.

BACKGROUND OF THE INVENTION

The use of paper tissues as a means to cleanse parts of the body to maintain hygiene has been in vogue in the western world since at least the $19^{th}$ century. These paper tissues commonly referred to as toilet paper are manufactured and marketed as rolls of fine tissue paper wound over a cardboard mandrel having a hollow core providing a through hole through which a suitable spindle or rod can be inserted, the spindle or rod being detachably mounted within a tissue holder that is permanently secured on a wall or other flat surface next to a toilet seat.

The use of facial tissues is more of a $20^{th}$ century phenomenon that arose due in part to the pressing need to replace re-usable handkerchiefs made of cloth which were found to retain and spread both airborne and contact disease germs. Facial tissues advantageously can be used once and discarded along with the germs deposited on them during use.

Facial tissue paper is generally marketed in the form of interleaved tissue sheets placed inside square or rectangular cardboard boxes and dispensed through a narrow slit at the top of the box. The clamor to make these tissue dispensing boxes aesthetically pleasing and have them match with the surrounding décor has spawned an industry of decorative facial tissue holding boxes made of plastic, metal, ceramic, wood and other materials. These decorative boxes with open bottoms are generally placed over the existing cardboard boxes holding the interleaved tissues and the tissue dispensed through an opening at the top of each box.

The use of rolled facial tissue unlike the rolled toilet tissue is not well known in the art. A roll of facial tissue much like a roll of toilet tissue would hold more tissues than the interleaved stack of tissues in a standard facial tissue box which makes the rolled tissue more economical in the long run. Accordingly, there is a need in the art for a device that can hold rolled facial tissue in a standard tissue box to replace the interleaved stack of tissues in the box. It would also be advantageous to have a device that can be used in conjunction with a wide variety of decorative tissue dispenser boxes available in the market without having to modify these tissue dispenser boxes to add a tissue holding device to each dispenser box that is marketed. The present invention provides such a device in the form of a rolled tissue dispenser stand that can be used with any standard facial tissue cardboard boxes and the decorative boxes available in the marketplace, without modifying these boxes.

Toilet tissue paper held on a mandrel or rod and dispensed by pulling down on the overlaying loose end of the paper generally results in the roll overspinning and dispensing more paper than is necessary, adding to the cost of frequent replacement of the roll. It would be beneficial to have a means to dispense toilet tissue paper from a roll in the same manner in which facial tissue is dispensed from a tissue dispenser box. The present invention of a rolled tissue dispenser stand can be advantageously used in dispensing toilet paper tissue from a standard tissue dispenser box or a modified dispenser box that might be needed to accommodate the larger toilet paper tissue roll.

The objects and embodiments of the present invention of a multipurpose rolled tissue dispenser stand will become obvious to those skilled in the art when viewed in conjunction with the summary of the invention, detailed description of the invention and the appended claims.

SUMMARY OF THE INVENTION

The present invention is a multipurpose rolled tissue dispenser stand which can be used advantageously with a roll of facial tissue, a roll of toilet tissue or rolls of other tissues such as hand wipe tissues.

It is an object of the present invention to provide a tissue dispenser stand to dispense a roll of facial tissue.

It is another object of the present invention to provide a tissue dispenser stand to dispense a roll of toilet paper tissue.

It is another object of the present invention to provide a tissue dispenser stand to dispense a roll of hand wiping tissues.

Yet another object of the present invention is to provide a rolled tissue dispenser stand that is portable.

A further object of the present invention is to provide a rolled tissue dispenser stand that can be accommodated within a standard square cardboard facial tissue dispenser box or a decorative square facial tissue dispenser box made from plastic, metal, wood or other suitable materials.

A related object of the present invention is to provide a rolled tissue dispenser stand that can be accommodated within a rolled toilet paper tissue box, a rolled hand wipe tissue box, or modified further to hold a roll of paper towels in a paper towel dispensing box.

In the exemplary embodiment of the present invention, the multipurpose rolled tissue dispenser stand is constructed using steel metal wire approximately 3/16 inches in diameter, thicker or thinner wires also may be used or, from metal or plastic tubing which may be injection molded or the parts constructed from wood or even heavy cardboard. In this embodiment of the invention, the tissue dispenser stand is constructed from a single length of metal wire or tubing that is bent at the top to form a horizontal rod section to hold the tissue dispenser unit and traverses down at both ends to form a pair of vertical rod sections that are further bent at the bottom ends to form the extended legs for the stand. In this embodiment, the rod that is used to hold the tissue roll is formed from a separate length of wire or tubing with the two ends of the tubing or wire soldered to the pair of vertical rod sections and held in place horizontally to hold the rolled tissue.

In yet another exemplary embodiment of the rolled tissue dispenser stand of the present invention, the stand is constructed by fitting the different tubing or wire sections to each other to complete the frame of the stand. In this embodiment of the rolled tissue dispenser stand of the invention, the pair of legs are connected to the bottom ends of the vertical rod sections and the horizontal rod section is connected to the top ends of the vertical rod sections to form the frame of the dispenser stand. The tissue holder rod is attached to the vertical rod sections midway between the legs and the horizontal rod section. In all embodiments of the rolled tissue holder stand of the invention, the tissue dispenser unit is held on the horizontal rod and is comprised of a base plate and a circular orifice with a serrated top end through which the tissue is dispensed. This part of the device may be made of plastic, stamped steel, wood or heavy cardboard. The loose end of the rolled tissue is pulled up through the orifice on the tissue dispenser unit to dispense the tissue. A decorative tissue holding box with an open bottom can be placed over the rolled tissue dispenser stand to provide a cover for the stand.

In yet another embodiment of the present invention, the rolled tissue dispenser stand can be modified and constructed to hold a standard roll of toilet tissue paper and placed inside a toilet paper tissue holding box.

In yet another embodiment of the present invention, the rolled tissue dispenser stand can be modified and constructed to hold a roll of hand wiping tissue paper and placed inside a hand wipe holder box.

In yet another embodiment of the present invention, the rolled tissue dispenser stand can be modified and constructed to hold a roll of paper towels and placed inside a paper towel holder box.

In all embodiments of the rolled tissue dispenser stand of the present invention, the tissue is dispensed automatically when pulled up by hand through the tissue dispenser orifice without the use of a motor, conveyer belt, or any other mechanical or manually actuable means.

In this summary of the invention, and in the specification in general, the various references to, "an exemplary embodiment," "yet another embodiment," and "related embodiment" do not necessarily refer to the same embodiment (s). Rather, these references to the various embodiments in general mean that a particular feature, structure, or characteristic described in conjunction with an embodiment is included in at least some embodiments, but not necessarily all embodiments of the invention.

Although the present invention has thus been described with reference to its exemplary and related embodiments, these embodiments should not be construed as limitations on the scope of the invention. It is to be understood by those skilled in the art, that the invention can be implemented in embodiments other than the ones described in this summary of the invention.

DETAILED DESCRIPTION OF THE INVENTION

The present invention is a multipurpose tissue dispenser stand that can be used for dispensing a roll of facial tissue, a roll of toilet paper tissue, a roll of hand wipe tissue, or a roll of paper towels. The rolled tissue dispenser stand can be placed inside a standard facial tissue dispenser box made of cardboard or other materials. The rolled tissue dispenser stand may be modified to accommodate larger rolls of tissue such as toilet paper tissue, or rolled paper towels.

Figure 1:
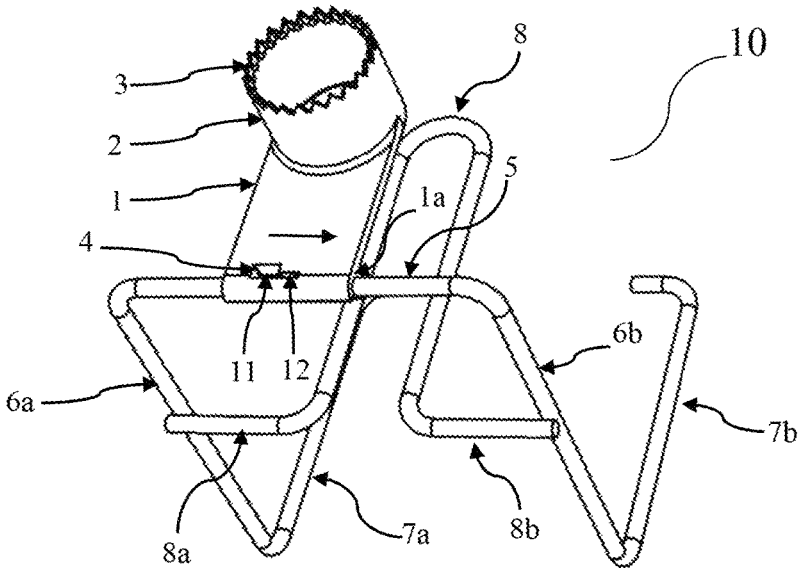
FIG. 1 is a perspective view of the exemplary embodiment of the rolled tissue dispenser stand of the present invention.

Referring now to the drawings wherein like numerals represent like components in the several views presented and discussed, and more particularly referring now to FIG. 1 the figure is a perspective view of the exemplary embodiment of the multipurpose rolled tissue dispenser stand 10 of the present invention. In this embodiment, the rolled tissue dispenser stand 10 of the invention is comprised of a pair of tubular legs 7*a* and 7*b* attached to tubular vertical rods 6*a* and 6*b* respectively. The tubular legs 7*a* and 7*b* have a distinct angular curve at their free ends as seen for tubular leg 7*b* in this figure. The angular curved ends of the tubular legs provide additional support for the tissue dispenser stand 10. A tubular tissue holding rod 8 having approximately 90 degree bends 8*a* and 8*b* at the two ends of the rod 8 is attached to the mid-sections of the vertical rods 6*a* and 6*b*. A tubular horizontal rod 5 is attached to the top ends of vertical rods 6*a* and 6*b* to complete the tubular frame of the rolled tissue dispenser stand 10. A tissue dispenser unit is attached to the mid-section of the horizontal rod 5. The tissue dispenser unit has a base plate 1 with a front end and a back end. The front end of the base plate 1 has a circular tissue dispenser orifice 2 with a serrated top 3 and the back end of the base plate 1 has a handle 1*a* and a lock 4 over the handle. The lock structure 4 is comprised of a keyed member 11 on the horizontal rod that slides in a slot 12 having two portions of different widths, a narrow width for locking and a wide width for unlocking the handle 1*a* to and from the horizontal rod 5 so that it can be locked and unlocked and move freely over the horizontal rod 5. The handle 1*a* is attached loosely to the tubular horizontal rod 5 to allow the tissue dispenser base plate 1 to be swung up for loading the roll of tissue onto the tissue holding rod 8 and brought down after loading the tissue roll onto the tissue holding rod 8. The handle 1*a* is actuated to lift up the base plate 1 when loading the roll of tissue onto the tissue holding rod 8 and actuated down and locked on to the horizontal rod 5 by means of lock 4 to let the base plate 1 lie horizontally over the tissue roll surface to hold the roll in place. The handle 1*a* also automatically actuates and lifts up the base plate 1 when tissue is dispensed through the orifice 2 of the dispenser unit if the handle 1*a* is not locked on to the tubular horizontal rod 5. Once the roll of tissue is loaded on the tissue holding rod 8 using the through hole of the tissue roll mandrel, the tissue dispenser handle 1*a* is swung down so that the base plate 1 lies horizontally over the roll of tissue. The lock 4 is then activated to slide into the narrow slot on the handle 1*a* to lock the tissue dispenser unit in place over the tissue roll. The serrated edge 3 at the top end of the tissue dispenser orifice 2 assists in easy separation of the tissue from the tissue roll when dispensed. In some embodiments of the tissue dispenser stand, the tissue dispensing orifice 2 may be square, triangular, or other shapes.

Figure 2:
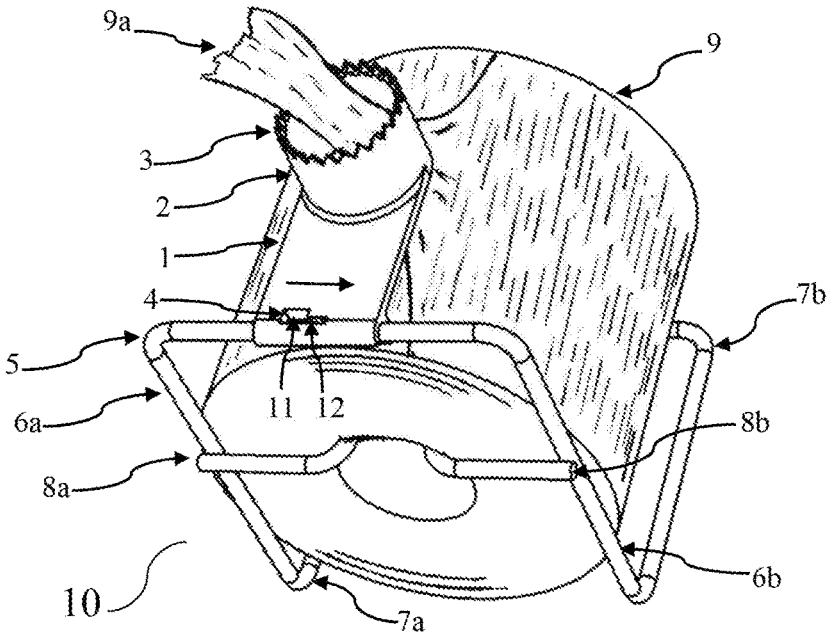
FIG. 2 is a perspective view showing the rolled tissue dispenser stand of the present invention holding a roll of tissue.

Referring now to FIG. 2 the figure is a perspective view showing the rolled tissue dispenser stand 10 of the present invention holding a rolled tissue 9. In this view, the tubular tissue holding rod (not seen here) with its back ends 8*a* and 8*b* attached to the vertical rods 6*a* and 6*b* is inserted into the through hole of the mandrel in the rolled tissue 9 and held in place on the rolled tissue stand 10 over the pair of tubular legs 7*a* and 7*b*. Once the rolled tissue 9 is inserted into the tissue holding rod 8 the base plate 1 of the tissue dispenser unit is brought down above the rolled tissue 9 and locked in place with the lock 4. The loose tissue end 9*a* of the rolled tissue 9 is then is pulled up through the tissue dispenser orifice 2 and separated with the help of the serrated edge 3 at the top end of the tissue dispenser orifice 2.

Figure 3:
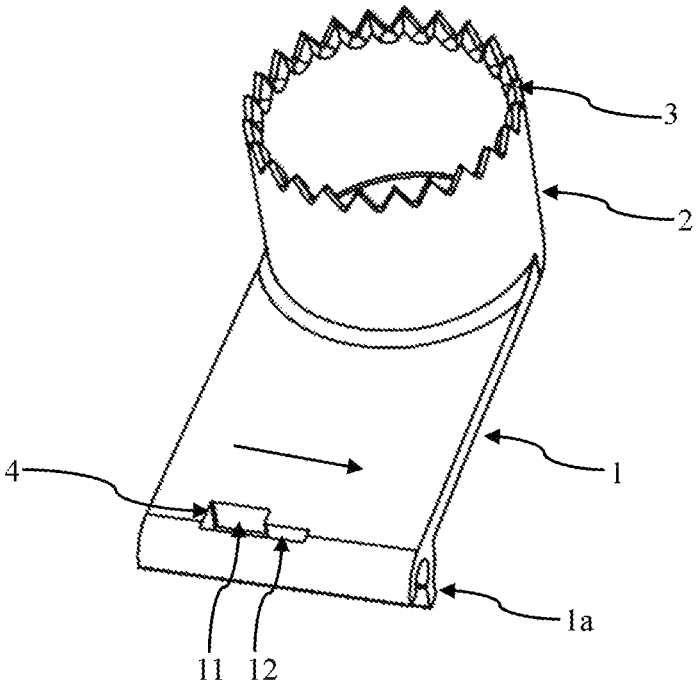
FIG. 3 is a perspective view of the tissue dispensing unit of the rolled tissue dispenser stand of the present invention.

FIG. 3 is a perspective view of the tissue dispensing unit of the rolled tissue dispenser stand of the present invention. The tissue dispenser unit is comprised of a base plate 1 a circular orifice 2 having a serrated edge 3 a handle 1*a* attached to the horizontal tubular rod of the rolled tissue dispenser stand and a lock 4 to lock the handle after the base plate 1 is swung down to lie over the roll of tissue.

Figure 4:
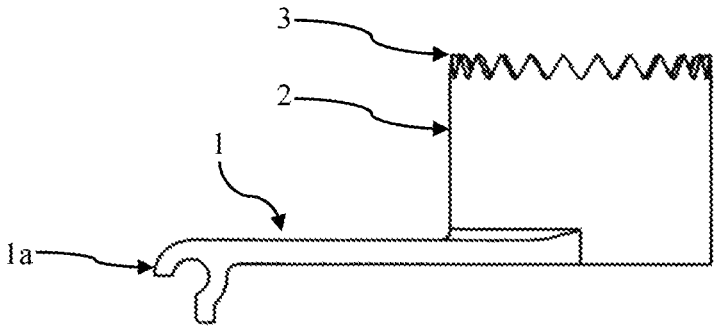
FIG. 4 is a side view of the tissue dispenser unit of the rolled tissue dispenser stand of the present invention.

FIG. 4 is a side view of the tissue dispenser unit of the rolled tissue dispenser stand of the present invention. This view shows the base plate 1 with the handle 1*a* that is used to attach the dispenser unit to the horizontal tubular rod of the rolled tissue dispenser stand. The base plate 1 is attached to the circular orifice 2 having a serrated edge 3 through which the loose end of the tissue is dispensed.

Figure 5:
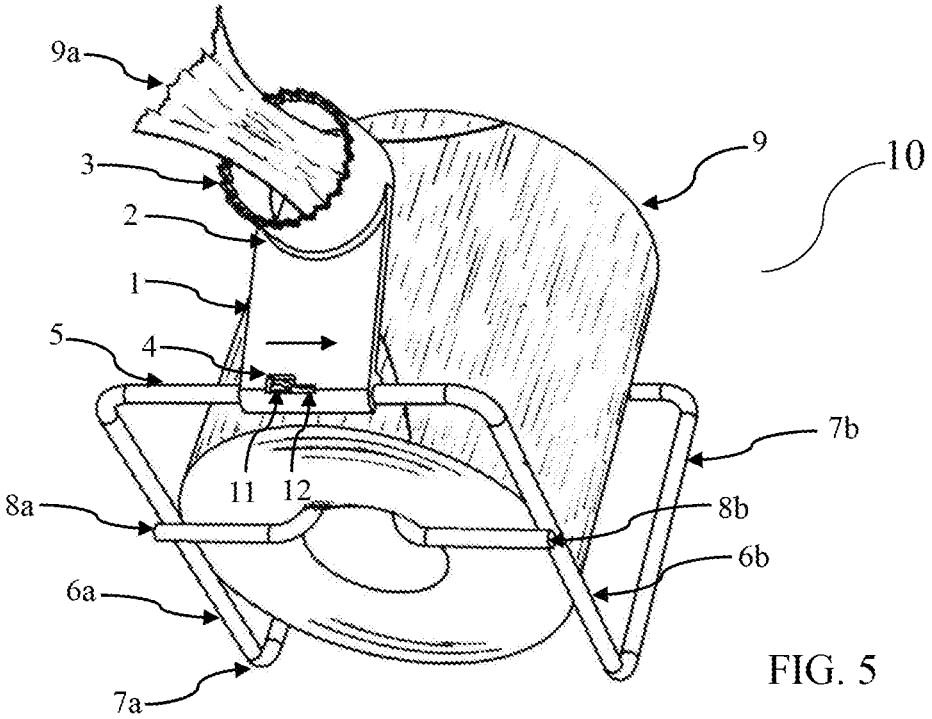
FIG. 5 is a perspective view showing the use of the rolled tissue dispenser stand holding a roll of tissue with the arm of the tissue dispenser unit lifted when the tissue is being dispensed.

FIG. 5 is a perspective view illustrating the use of the rolled tissue dispenser stand 10 when the handle 1*a* at the back end of the base plate 1 is in the unlocked state. This view shows the base plate 1 comprising the tissue dispenser orifice 2 with the serrated edge 3 in the lifted position when the loose tissue end 9*a* from the rolled tissue 9 is dispensed from the circular orifice 2. The base plate 1 is swung down by actuating the handle at the back end of the base plate 1 to lie parallel and close to the top of the tissue roll 9 to hold it in place on the stand over the tubular legs 7*a* and 7*b*. The lock 4 on the handle is used to lock the tissue dispenser unit over the tissue roll 9.

Figure 6:
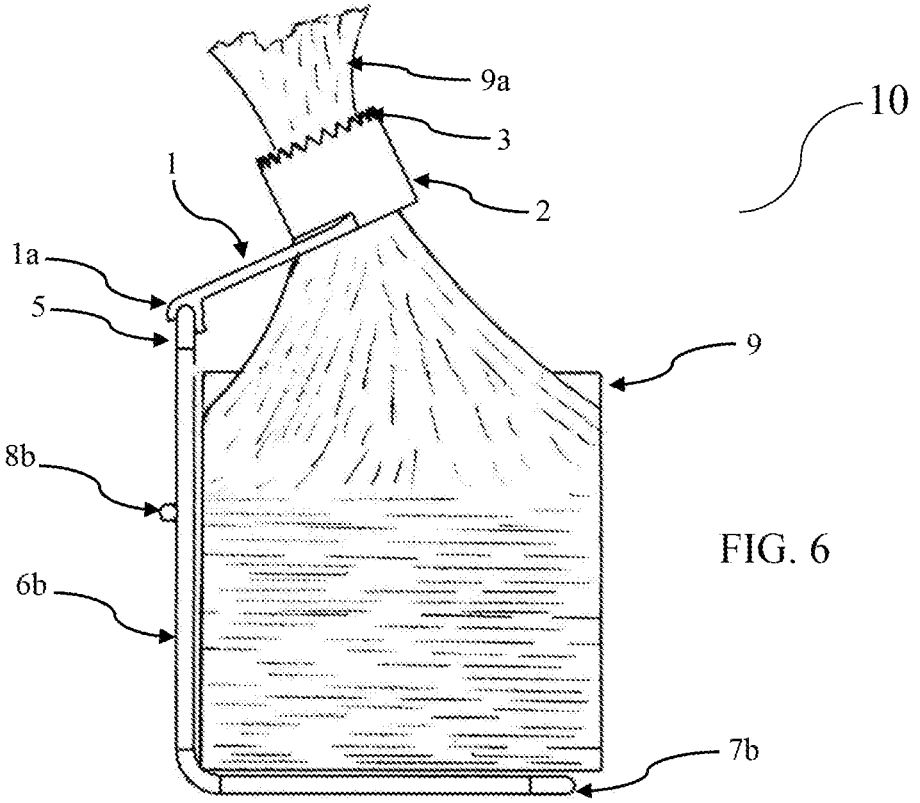
FIG. 6 is a side view of the rolled tissue dispenser stand of the present invention holding the roll of tissue with the arm of the tissue dispenser unit lifted when the tissue is being dispensed.

FIG. 6 is a side view of the rolled tissue dispenser stand 10 of the present invention holding the rolled tissue 9 with the tissue dispenser unit base plate 1 seen lifted up when the loose tissue end 9*a* is pulled through the orifice 2 to dispense the tissue when the handle 1*a* is in the unlocked position.

Figure 7:
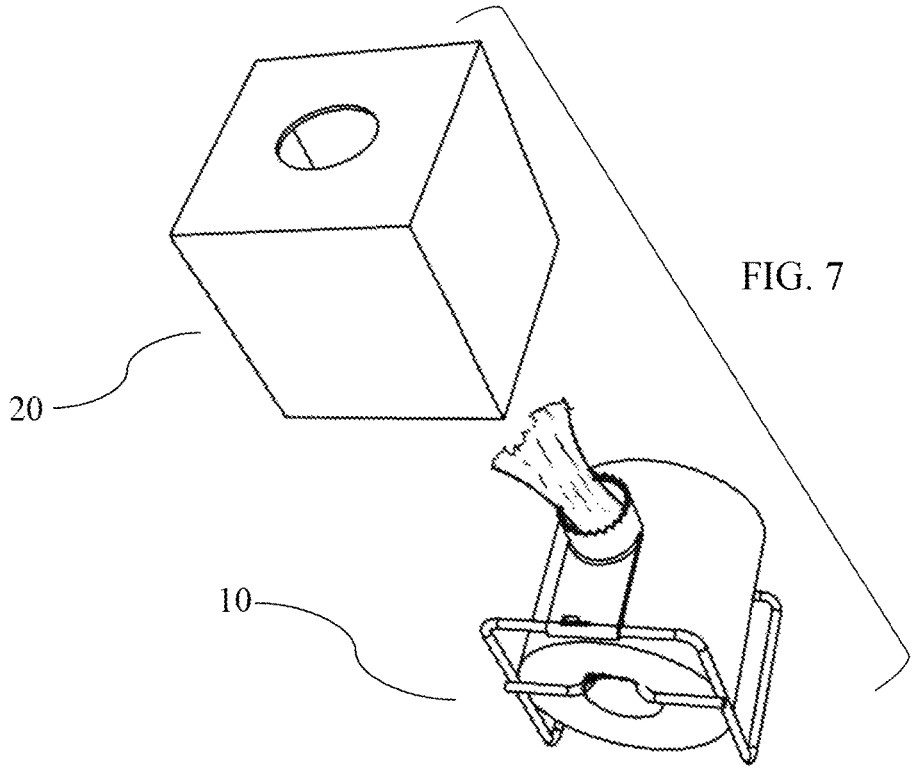
FIG. 7 is an exploded perspective view illustrating how a standard facial tissue dispenser box is inserted over the rolled tissue dispenser stand of the invention holding the roll of tissue.

FIG. 7 is an exploded perspective view illustrating how a standard tissue dispenser box 20 is inserted over the rolled tissue dispenser stand 10 of the invention holding the roll of tissue. The standard tissue dispenser box 20 for use with the rolled tissue dispenser stand 10 of the present invention would have an open bottom which can be placed over the rolled tissue dispenser stand 10 of the present invention to cover the stand from view.

Figure 8:
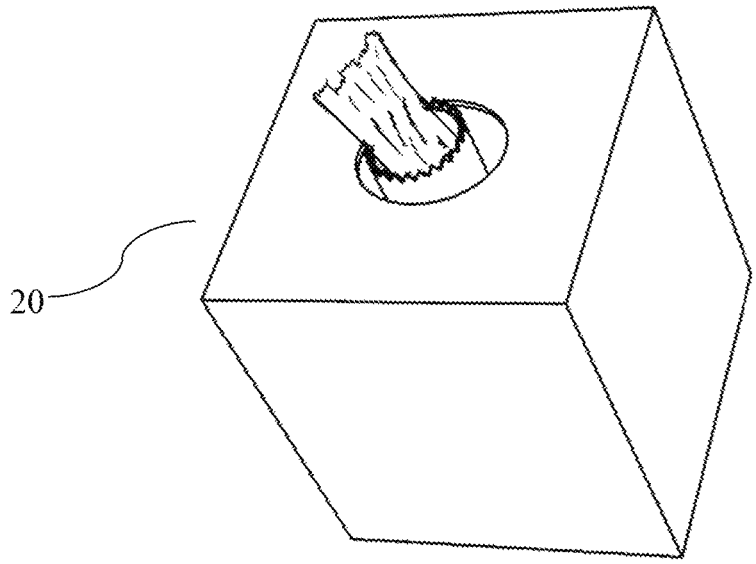
FIG. 8 is a perspective view of the tissue being dispensed through the orifice of the dispenser unit that is accommodated within the opening at the top of a standard facial tissue dispensing box that is placed over the tissue dispensing stand of the invention.

FIG. 8 is a perspective view of the tissue being dispensed through the orifice 2 of the dispenser unit that is accommodated within the opening at the top of a standard facial tissue dispensing box 20 having an open bottom that is placed over the rolled tissue dispensing stand of the invention.

While the exemplary embodiment of the present invention of a multipurpose rolled tissue dispenser stand has thus been described through its preferred embodiments and related figures, it is to be understood that the embodiments of the present invention as described herein do not limit any application or scope of the invention and that the invention can be carried out and practiced in various ways and implemented in embodiments other than the ones outlined and described above. It should be understood and obvious to one skilled in the art that alternatives, modifications, and variations of the embodiments of the present invention may be construed as being within the spirit and scope of the appended claims.

What is claimed is:

1. A rolled tissue dispenser stand, said rolled tissue dispenser stand comprising:

a pair of tubular vertical rods, a pair of tubular legs, a tubular horizontal rod, a tubular tissue holding rod and a tissue dispenser unit structure;

said pair of tubular vertical rods each having a base ends and a top end;

said pair of tubular legs having a front end and a back end;

said front ends of said pair of tubular legs having an angular bend;

said base end of each of said tubular vertical rods attached to said back end of each of said pair of tubular legs;

said tubular horizontal rod having a first end and a second end;

said top end of each of said tubular vertical rods attached to said first end and said second end of said tubular horizontal rod;

said tubular tissue holding rod having angular bends at a first end and a second end of said tubular tissue holding rod;

said first end and said second end of said tubular tissue holding rod attached to a midsection of said pair of tubular vertical rods;

said tissue dispenser unit structure having a base plate with a front end and a back end;

a tissue dispenser orifice attached to said front end of said base plate;

said tissue dispenser orifice having a serrated edge at a top end;

said back end of said base plate having a handle structure;

said handle structure at said back end of said base plate hingedly attached to said horizontal tubular rod; and a lock structure comprising a slot on said handle structure configured with a locking narrow slot portion and a wide unlocked slot portion on said handle structure integrally aligned and connected with a keyed member on said tubular horizontal rod to lock said handle structure to said tubular horizontal rod to hold down said tissue dispenser unit structure over a roll of tissue inserted on said tubular tissue holding rod structure and to unlock said handle structure to lift up said tissue dispenser unit structure when inserting a roll of tissue onto said tissue holding rod.

2. The rolled tissue dispenser stand of claim 1 wherein when the handle structure at the back end of the base plate hingedly attaching the base plate to the tubular horizontal rod is unlocked by sliding the keyed member into the wide slot portion of the handle structure, the handle structure is actuated to lift up the base plate to insert a roll of tissue onto the tubular tissue holding rod and once the tissue roll is inserted onto the tubular tissue holding rod, the handle structure is actuated to bring down the base plate over the rolled tissue and the keyed member is slid into the narrow slot portion on the handle structure to lock the base plate in place over the tissue roll.

3. The rolled tissue dispenser stand of claim 1 wherein the handle at the back end of the base plate hingedly attaching the base plate to the tubular horizontal rod is automatically actuated to lift up the base plate when the loose end of a tissue is pulled out from the tissue dispenser orifice when the handle is in the unlocked state.

4. The rolled tissue dispenser stand of claim 1 wherein a tissue dispenser box made of cardboard or other materials having an open bottom is placed over the rolled tissue dispenser stand before dispensing the tissue.

5. The rolled tissue dispenser stand of claim 1 wherein the stand is used to dispense rolled facial tissue.

6. The rolled tissue dispenser stand of claim 1 wherein the stand is used to dispense rolled toilet paper tissue.

7. The rolled tissue dispenser stand of claim 1 wherein the stand is capable of accommodating a roll of hand wipe tissues.

8. The rolled tissue dispenser stand of claim 1 wherein the stand is capable of accommodating a roll of hand wipe tissues.

* * * * *